United States Patent [19]

Fried

[11] 3,989,147

[45] Nov. 2, 1976

[54] BULK CEMENT STORAGE SYSTEM

[76] Inventor: Morton Fried, 705 Bolton Road, Far Rockaway, N.Y. 11691

[22] Filed: Jan. 30, 1975

[21] Appl. No.: 545,297

[52] U.S. Cl. ..... 214/14; 302/52

[51] Int. Cl.[2] ..... B65G 67/58; B65G 53/40

[58] Field of Search ..... 214/14; 302/52, 53, 302/29

[56] References Cited

UNITED STATES PATENTS

| | | | |
|---|---|---|---|
| 3,236,422 | 2/1966 | Bailey | 302/53 |
| 3,381,831 | 5/1968 | Tanehiko | 214/14 |
| 3,514,158 | 5/1970 | Stahler | 302/52 |

*Primary Examiner*—Philip Goodman
*Attorney, Agent, or Firm*—Samson Helfgott

[57] ABSTRACT

A bulk cement storage system which includes storage units for storing the cement, as well as devices for transporting the cement to the storage units and removing the cement from the storage units. The storage units include a circular base member with a hole in its center which slopes inward at a shallow angle toward the hole. A number of porous sections are formed in the base member to permit a stream of compressed air to pass through the porous sections into the stored cement. A generally circular shaped dome covers the base member to provide environmental protection for the storage area. The cement is stored as a free standing pile on the base member within the storage area. The compressed air causes the cement to develop flow characteristics similar to a liquid, so that the cement can be removed from the storage bin utilizing a pneumatic conveying system.

12 Claims, 9 Drawing Figures

BULK CEMENT STORAGE SYSTEM

BACKGROUND OF THE INVENTION

This invention relates to cement handling systems and more particularly to a bulk cement storage system utilizing an improved storage unit.

Originally, after being manufactured, cement was stored in large, low level sheds either loose or in bags. The cement, if stored loose was shoveled from the sheds to a ship or car for transportation, or, if stored in bags, were stacked and carried off. However, environmental conditions proved such storage methods both inefficient and costly since much cement was damaged by environmental conditions. As a result, bulk handling technology developed, utilizing cast concrete cylinders, generally called "silos" to hold the loose cement. These silos were tall and narrow so that the height of the stored cement would provide the force for getting the cement out of the bottom of the silos by convenient mechanical means. With the development of pneumatic conveyors, improved bulk handling techniques resulted. The cement could now be speadily transferred from ships to storage sites and from storage sites to transportation means such as trains or trucks. However, the silos were still utilized for the storage of the cement.

Bulk transport of cement is generally carried out by means of covered hopper cars at plants which have the availability of a railroad siding. At locations generally removed from railroad lines, pneumatic truck trailers are utilized. The pneumatic conveyors bring and remove the cement to these cars and trucks. Furthermore, pneumatic conveyors have played an important role in the development of the marine distribution of cement. Many bulk handling ships are virtually self unloading. The cement is stored in the floors of the holds of the ship and the cement is extracted and transferred to a dockside storage facility which is then utilized to distribute the cement to the various locations.

The use of bulk handling technology for cement has provided both time and cost savings. Further advantages of the bulk storage and handling of cement include the avoidance of broken bags of cement, the necessity to provide dry storage areas, as well as permitting the use of bulk distribution to batch manufacturing sites.

Despite the development of bulk handling technology, as well as the pneumatic conveyor systems, the installation of a cement storage and distribution center has been extremely costly and required a great amount of time to construct the distribution center. A basic reason for this cost is that the cement is stored in series of silos. The silo construction generally takes years and is very expensive. A typical cylindrical silo unit is about 10 meters in diameter and can be as high as 50 meters. The cement is fed into the storage silos and retained therein until distribution is needed. Because of the poor flow characteristics of the cement, the silos are typically very tall and narrow so that a flow of the cement can be obtained by the gravitational force on the column of cement which pushes it downward. The cement can then be removed at the bottom of the silo by means of a screw mechanism or a solid fuel pump. The powdered cement when stacked to such a great height in the silo tends to transfer its weight to the walls of the silo container as well as to the base of the silo. Because of the great height, it is necessary that the walls of the silo be very thick and strong throughout the full height of the storage container. This causes the silos to be very expensive in construction and necessitates great amounts of time to build these distribution centers.

It is accordingly an object of the present invention to avoid the aforementioned problems of prior art devices. A further object of the present invention is to provide a bulk cement storage system which can be constructed at reduced cost and shorter periods of time.

Yet a further object of the present invention is to provide a bulk cement storage system which utilizes a storage unit that does not require very thick, strong, weight bearing walls.

A further object of the present invention is to provide a bulk cement storage system which permits the storage of cement in a free standing pile and is covered by a protective dome of light weight construction.

These and other objects, features and advantages of the invention will, in part, be pointed out with particularity, and will, in part, become obvious from the following more detailed description of the invention, taken in conjunction with the accompanying drawings, which form an integral part thereof.

SUMMARY OF THE INVENTION

Briefly, the invention describes a bulk cement storage system which includes a storage unit having a circular base member with an outer edge and a centrally located opening. The base member slopes at a shallow angle from its outer edge inwardly toward the central opening. A plurality of porous sections are formed in the base member and extend radially toward the central opening. A generally circular shaped dome is placed coaxial with the base member to cover it, thereby forming a storage area. The maximum height of the dome is at least one half of the diameter of the base member. Means are provided for flowing a stream of compressed air through the porous section into the storage area. Input means are coupled to the upper portion of the dome for feeding cement into the storage area. Output means are coupled to the central opening and include a pneumatic conveying system for removing cement from the storage area. The cement can be stored on the base member in a free standing pile and can be removed by passing the compressed air through the porous sections to fluidize the cement and permit it to flow out of the central opening.

BRIEF DESCRIPTION OF THE DRAWINGS

In the drawings.

In the various figures of the drawing, like reference characters designate like parts.

DESCRIPTION OF THE PREFERRED EMBODIMENTS

Figure 1:
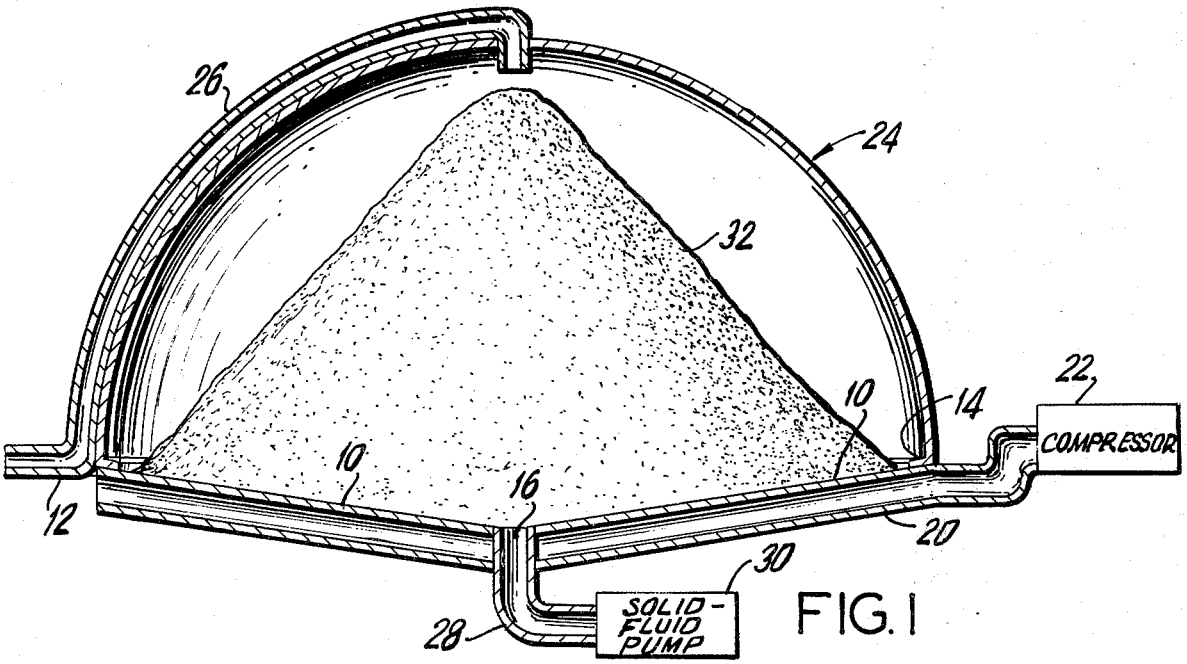
FIG. 1 is a sectional side view of the storage unit in accordance with one embodiment of the present invention.
Figure 2:
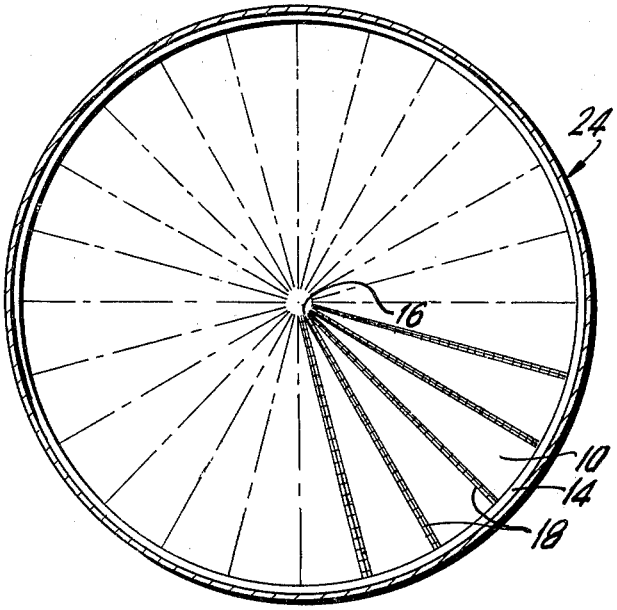
FIG. 2 is a plan view of the base member of the storage unit in accordance with one embodiment of the present invention.

Referring now to FIGS. 1 and 2 there is shown an embodiment of the storage unit including a circular base member 10 which is placed on the ground or other support surface 12 and includes an outer edge 14 and a cylindrical central opening 16. The base member is slightly sloped towards its center to form a shallow funnel. The slope being typically less than 10°. The base member includes a number of porous sections 18 which extend radially from the outer edge to the central opening. A lower layer, which can include a pipe system 20 passes underneath the base member and engages the porous sections to pass compressed air through the porous sections of the base. An air compressor 22 is coupled to the edge of the lower layer 20. A generally circular shaped dome 24 is placed coaxial with the base member and covers it. The dome is shown located near the edge of the base member. Input means, shown including the input pipe 26, is coupled to the upper portion of the dome and extends through the dome into the storage area. Cement is fed into the storage area through the input means. An output means, including the output pipe 28 is coupled to the central opening in the base member. A pneumatic conveying system would be coupled to the output means and a solid-fluid pump shown generally at 30 would be utilized to remove the cement stored in the storage area.

The cement fed into the storage area will form a free-standing pile, generally in the form of a cone shown at 32. The cement will exert its weight on the base member 10, but the circular shaped dome 24 will cover the free-standing pile without bearing any of the weight against its walls. The dome shaped member can therefore be of lightweight construction and is utilized essentially for environmental protection of the free-standing pile. One type of dome which can be used is a geodesic dome which is constructed of many geodesic pieces. The dome can be prefabricated at a separate location and quickly assembled at the construction site. The only construction necessary at the storage location is the base member and cooperating layer for forcing compressed air through the porous regions.

When compressed air passes in contact with the cement, the cement develops the flow characteristics of a liquid and easily flows along the sloped surface of the base member toward the center opening. The cement is essentially "fluidized" and can easily be pumped out of the storage area utilizing a pneumatic solid-fluid pump.

Figure 5:
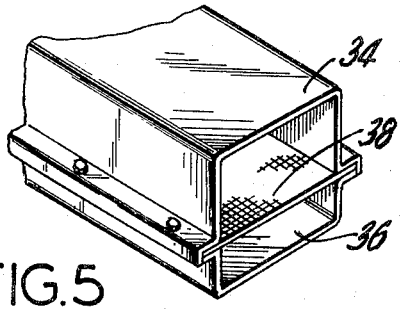
FIG. 5 is an isometric view of a pneumatic conveyor which is utilized in accordance with an embodiment of this invention.

By using pneumatic conveyors and gravity conveyors for the pipes leading into and out of the storage unit, the cement can maintain its fluid properties and flow from the storage unit to various hoppers where it can then be transferred to bulk handling trucks. Referring now to FIG. 5, there is shown one section of a gravity feed conveyor of the type commonly used in the industry. Such conveyor includes an upper section 34 in which the cement passes and a lower section 36 in which the compressed air flows. A porous member 38 separates the two sections permitting the compressed air to enter into the dry cement. By slightly tilting the conveyor, the cement then flows as a liquid through the conveying members.

Figure 3A:
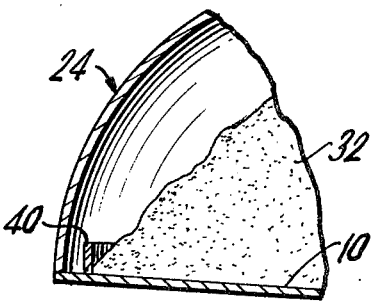
FIGS. 3A, 3B, and 3C show various embodiments for providing support to the pile at its base edge.
Figure 3B:
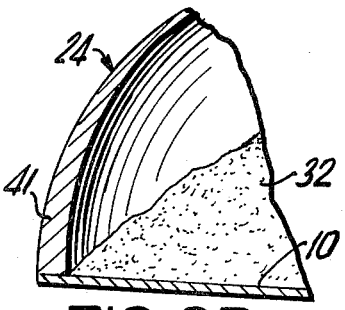
Figure 3C:
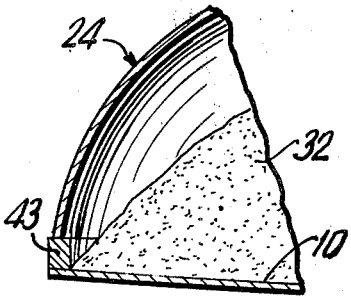

If desired, the storage area could include a support means at the bottom edge of the pile of cement. Such support means could be a short base edge wall 40 constructed within the area covered by the dome and located adjacent the other edge of the base member as shown in FIG. 3A. This wall would be thick enough to provide weight bearing support. It will retain the bottom edge of the free standing pile and prevent it from pressing against the bottom edge of the dome 24. Alternatively, the bottom edge of the dome itself could be constructed to support the bottom edge of the cement pile. This could be achieved by making the bottom of the wall thicker, as at 41 in FIG. 3B, and gradually tapering it to its generally thin shape. Also, a thicker plate 43 could be placed at the bottom edge, as in FIG. 3C. Other similar means could be used.

The height of the dome at its maximum point is at least one half the diameter of the base member. The cement pile, fed from the top of the dome, builds up a slope of approximately 55°–60°. The pile will form into a cone shape. It is calculated that 12,000 tons of cement will rise to a height of approximately 22 meters and will be approximately 44 meters across.

Figure 4A:
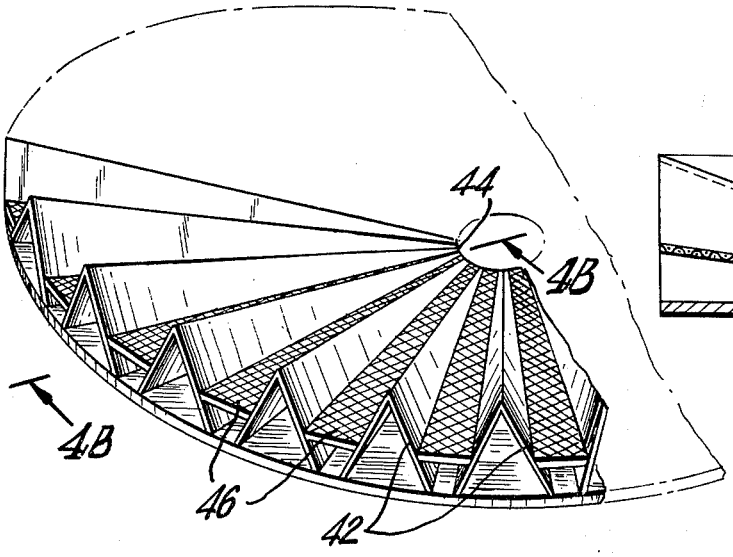
FIG. 4A is an isometric view of the base member in accordance with a further embodiment of the present invention.
Figure 4B:
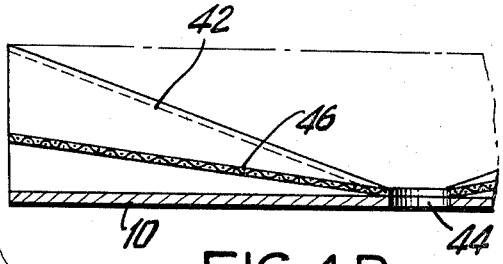
FIG. 4B is a section thereof.

Referring now to FIG. 4A, there is shown an alternative embodiment for the construction of the base member of the storage unit. The base member includes a plurality of triangular shaped troughs 42 extending radially toward the central opening 44 of the base member. At the bottom of the troughs are located the porous sections 46. The troughs are also formed to slope inwardly toward the central opening, as shown in FIG. 4B. The use of the triangular shape in combination with the slope permits improved flow of the cement towards the central opening and reduces the amount of porous material which must be utilized to fluidize the cement.

Figure 6:
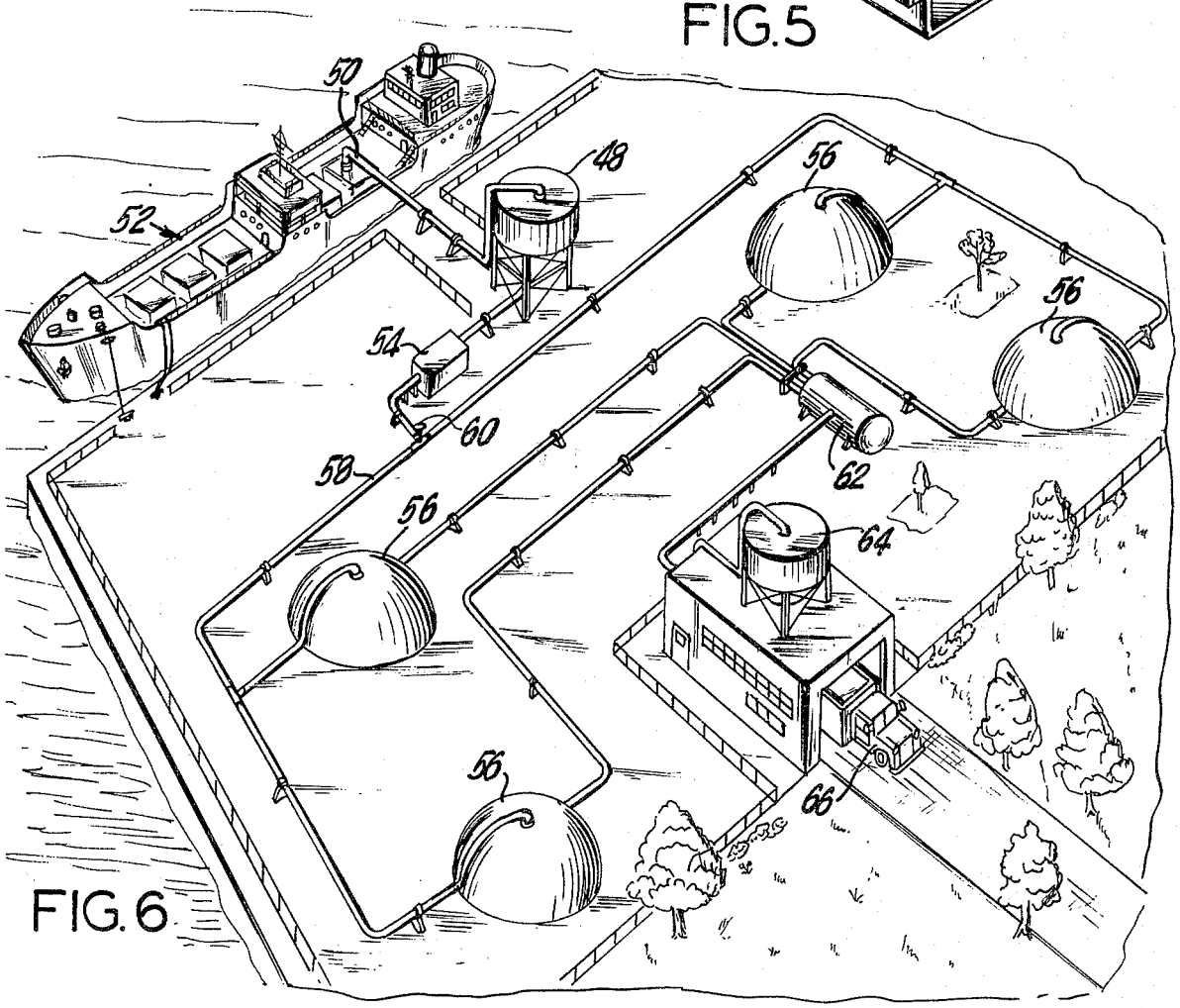
FIG. 6 is a schematic diagram of a cement storage system in accordance with an embodiment of the present invention.

Referring now to FIG. 6 there is shown an overall bulk cement storage system utilizing the storage unit of the type heretofore described. The system includes a dockside hopper 48 which is used to transfer cement via pneumatic pipeline 50 from a bulk carrying vessel 52. The bulk carrying vessel can either be located adjacent the dockside facility or can be offshore utilizing extended lengths of pneumatic pipeline. A solid fuel pump 54 transfers the cement from the dockside hopper to the storage units 56 by means of the pneumatic pipelines 58. Transfer valves 60 control the flow the cement to the storage units. Centrally located solid fuel pump 62 transfers the cement from the storage units to a loadout hopper 64 which can be used to transfer the cement to bulk carrying trucks 66 or bulk carrying rail cars.

Although not shown, it is understood that the system would include compressors to provide the conveying air for transporting the cement in the pneumatic pipeline as well as for providing the compressed air into the base members of the storage units. Furthermore, a dust collector could be included to provide the ventilation and removal of dust from the area. Blowers could be included within the pneumatic pipeline to further force the compressed air along the pipeline sections. The base member could typically be of steel or concrete while the generally circular shaped dome could be of a lightweight type of construction such as fiberglass material, thin sheet metal or plastic. It is understood that the system is reversable, i.e., cement may originate from a manufacturing plant, or trucks, and be pumped out directly into ships.

There has been disclosed heretofore the best embodiment of the invention presently contemplated. However, it is to be understood that various changes and modifications may be made thereto without departing from the spirit of the invention.

I claim:

1. A bulk cement storage system comprising:

a circular base member for supporting a free standing cement pile and having an outer edge, a centrally located opening, and sloping from said outer edge to said central opening;

a plurality of porous sections formed in said base member and extending radially toward said central opening;

a generally circular shaped dome coaxial with said base member, having its largest dimension positioned on said base member, and covering it to form a storage area, the maximum height of said dome being at least one half the diameter of said base member;

means for providing a stream of compressed air through said sections into said storage area;

input means coupled to the upper portion of said dome for feeding cement into said storage area, and output means coupled to said central opening including a pneumatic conveying system for removing said cement from said storage area.

2. The system as in claim 1 and wherein said dome is directly coupled to said base member at the outer edge thereof.

3. The system as in claim 1 and wherein said dome is in the form of a geodesic constructed dome.

4. The system as in claim 1 and further comprising a short cylindrical wall coupled near the outer edge of said base member and located inward of said dome.

5. The system as in claim 1 and wherein said dome has a weight supporting means at the bottom thereof coupled to said base member.

6. The system as in claim 1 and wherein said base member is constructed in the form of a plurality of trough shaped bins extending radially towards said central opening, and wherein said porous sections are formed at the bottom of said bins.

7. The system as in claim 1 and wherein said dome is constructed of lightweight material incapable of providing bearing support to a column of cement.

8. The system as in claim 1 and further comprising a solid fuel pump connected in said pneumatic conveying system.

9. The system as in claim 1 and wherein said input means also comprises a pneumatic conveying system.

10. The system as in claim 1 and wherein said base member slopes toward said central opening at an angle of less than 10 degrees.

11. The system as in claim 1 and further comprising:

dockside unloading facility means for removing cement from a vessel;

dockside hopper means for receiving the cement removed from said vessel;

pneumatic transport means for conveying the cement from the dockside hopper to the input means;

output hopper means coupled to the pneumatic conveying system of the output means, and solid-fuel pumps for controlling the flow of the cement through the system.

12. The system as in claim 1 and further comprising a gravity conveying system coupled to said pneumatic conveying system and including conveyors having an upper section in which the cement can flow, a lower section in which the compressed air can flow, and a porous medium separating said two sections.

* * * * *